US007351306B2

(12) United States Patent
Lindstrom et al.

(10) Patent No.: US 7,351,306 B2
(45) Date of Patent: Apr. 1, 2008

(54) COOKING OF CELLULOSE PULP IN A COOKING LIQUOR CONTAINING PRE-EVAPORATED BLACK LIQUOR

(75) Inventors: Mikael Lindstrom, Stockholm (SE); Vidar Snekkenes, Karlstad (SE)

(73) Assignee: Metso Fiber Karlstad AB (SE)

( * ) Notice: Subject to any disclaimer, the term of this patent is extended or adjusted under 35 U.S.C. 154(b) by 138 days.

(21) Appl. No.: 10/501,246

(22) PCT Filed: Jan. 17, 2003

(86) PCT No.: PCT/SE03/00066

§ 371 (c)(1),
(2), (4) Date: Jul. 12, 2004

(87) PCT Pub. No.: WO03/062524

PCT Pub. Date: Jul. 31, 2003

(65) Prior Publication Data

US 2005/0115691 A1 Jun. 2, 2005

(30) Foreign Application Priority Data

Jan. 24, 2002 (SE) ..... 0200189

(51) Int. Cl.
*D21C 3/26* (2006.01)
*D21C 3/24* (2006.01)
*D21C 3/02* (2006.01)

(52) U.S. Cl. ..... 162/19; 162/30.1; 162/42

(58) Field of Classification Search ..... 162/19, 162/30.1, 33, 37, 38, 41, 30.11, 42; 159/47.3; 106/123.11
See application file for complete search history.

(56) References Cited

U.S. PATENT DOCUMENTS 2,747,552 A * 5/1956 Kyrklund ..... 588/320
3,258,390 A * 6/1966 Tomlinson, II ..... 162/17
3,303,088 A * 2/1967 Gessner ..... 162/19
3,414,038 A * 12/1968 Laakso ..... 159/17.1
3,525,666 A * 8/1970 Brannland ..... 162/30.11

(Continued)

FOREIGN PATENT DOCUMENTS

FR 2584433 A1 * 1/1987

(Continued)

OTHER PUBLICATIONS

Sven A. Rydholm, Pulping Processes, 1967, Interscience Publishers, pp. 769 & 774.*

*Primary Examiner*—José A. Fortuna
(74) *Attorney, Agent, or Firm*—Rolf Fasth; Fasth Law Office

(57) ABSTRACT

The method is for cooking of cellulose pulp in which the raw material, preferably in the form of chips, undergoes a successive elevation of temperature towards the cooking temperature while the chips are first impregnated with an impregnation liquor followed by cooking in a cooking liquor that is preferably alkali. Through the addition of pre-evaporated black liquor, either as early as the impregnation stage or during the subsequent cooking stage, an improved delignification process is achieved in which the pulp obtains improved properties, primarily with respect to strength/viscosity for a given degree of delignification, and also with respect to yield. The method can be used both for continuous cooking and for batch cooking of cellulose pulp.

12 Claims, 1 Drawing Sheet

U.S. PATENT DOCUMENTS

| | | | | |
|---|---|---|---|---|
| 4,944,840 | A * | 7/1990 | Henricson et al. | 162/46 |
| 5,080,755 | A * | 1/1992 | Backlund | 162/19 |
| 5,480,512 | A * | 1/1996 | Sannholm | 162/16 |
| 5,643,410 | A * | 7/1997 | Hiljanen et al. | 162/37 |
| 5,885,414 | A * | 3/1999 | Lindstrom et al. | 162/19 |
| 6,346,166 | B1 * | 2/2002 | Kettunen et al. | 162/14 |
| 6,468,390 | B1 * | 10/2002 | Snekkenes et al. | 162/19 |
| 7,214,291 | B2 * | 5/2007 | Gustavsson et al. | 162/9 |
| 7,270,725 | B2 * | 9/2007 | Lindstrom et al. | 162/19 |
| 2001/0032711 | A1 * | 10/2001 | Stromberg et al. | 162/17 |
| 2004/0079498 | A1 * | 4/2004 | Haaslahti et al. | 162/19 |
| 2005/0103454 | A1 * | 5/2005 | Lindstrom et al. | 162/19 |
| 2005/0115691 | A1 * | 6/2005 | Lindstrom et al. | 162/19 |
| 2005/0161177 | A1 * | 7/2005 | Gustavsson et al. | 162/9 |
| 2005/0252625 | A1 * | 11/2005 | Lindstrom et al. | 162/57 |
| 2006/0070710 | A1 * | 4/2006 | Hernesniemi et al. | 162/29 |
| 2007/0131363 | A1 * | 6/2007 | Kettunen et al. | 162/29 |

FOREIGN PATENT DOCUMENTS

| | | | |
|---|---|---|---|
| JP | 2005515319 | W * | 5/2005 |

* cited by examiner

COOKING OF CELLULOSE PULP IN A COOKING LIQUOR CONTAINING PRE-EVAPORATED BLACK LIQUOR

PRIOR APPLICATION

This application is a U.S. national phase application based on International Application No. PCT/SE03/00066, filed Jan. 17, 2003, claiming priority from Swedish Patent Application No. 0200189-9, filed Jan. 24, 2002.

TECHNICAL FIELD

The present invention concerns a method for the production of cellulose by cooking cellulose pulp in a cooking liquor containing pre-evaporated black liquor.

THE PRIOR ART

The technology of cooking has undergone significant development for several decades. During the 1960s and 1970s, systems were used in which essentially all liquor for cooking, including white liquor, were added in batches at the pre-treatment stage. Cooking in continuous digesters subsequently took place in the same liquor down through the digester, and the liquor was then withdrawn. Relatively high levels of alkali were established at the start of the cooking stage, such that sufficient alkalinity was be maintained throughout the complete cooking stage. It became clear that the high levels of alkali at the beginning of the cooking stage were detrimental to the quality of the pulp, and this led to several variations on this system being suggested. These variations include such techniques as MCC (modified continuous cooking), ITC (isothermal cooking) using the same cooking temperature throughout the digester, and EMCC (extended modified cooking).

Later, during the 1980s, black liquor impregnation, in which liquor used in the cooking stage is reintroduced to constitute part of the impregnation liquor, was developed for both batchwise cooking and for continuous cooking. In this case, white liquor could be added batchwise at the end of the impregnation, or at the beginning of the cooking stage. The used cooking liquor, i.e. the black liquor, that was withdrawn from the cooking stage could in this case have a relatively high residual alkali content, on which this withdrawn black liquor was reintroduced to the impregnation. Here, most of the residual alkali was consumed before the used impregnation liquor was sent to recovery following withdrawal (concentration by evaporation and soda recovery furnace). This technique allowed a lower level of alkali to be established at the beginning of the cooking stage.

Several solutions are known in which black liquor is used as an impregnation liquor in an impregnation zone before cooking. A system is revealed in U.S. Pat. No. 5,080,755 that has black liquor in the input. A variant is revealed in U.S. Pat. No. 5,053,108 in which black liquor withdrawn from the digester is recycled to the high-pressure layer in order to there form the major part of the treatment liquor in the transfer circulation for the digester. A variant that has been developed further is revealed in EP477059, in which wood chips impregnated with black liquor are raised to cooking temperature before the main addition of white liquor. These show that many different suggestions for process have been studied, with the aim of improving the quality of the pulp while at the same time maintaining the high degree of delignification in the pulp that is washed after cooking.

Marketing by Andritz-Ahlstrom of another cooking technology, denoted by LO-SOLIDS, began during the 1990s. This involves the continuous withdrawal of cooking liquor with a high degree of organic material and the replacement of this by new or treated cooking liquor that has a lower level of dissolved organic material (DOM/dissolved organic material). However, this system suffers from the disadvantage that the cooking process often results in a lower yield, caused by the fact that with the withdrawn organic material, such as lignin, also contains carbohydrates, principally hemicellulose.

Other methods of improving the cooking stage, both with respect to yield and with respect to pulp quality, are the addition of polysulphide, AQ or dissolved Xylan.

The yield is highly significant during cooking since an increase of only 1% means that a production facility of normal size, having an output of 1,500 tonnes a day, would experience an increase in production of 15 tonnes, which, with a pulp price of 700 USD/ADT, gives an increased income of 10,500 USD a day.

THE AIM AND PURPOSE OF THE INVENTION

Subject to the developments in cooking technology, principally the technology used in continuous cooking, two dominating technologies are currently available. These are the technique known as "LO-SOLIDS" and the technique developed by Kvaerner Pulping AB known as "COMPACT COOKING". Extremely high liquor/wood ratios are established during COMPACT COOKING in the initial phases of the cooking stage, with a very high level of black liquor present in the cooking liquor.

It has now become clear, surprisingly, that a very favourable delignification is established during the cooking stage if black liquor is present in the cooking liquor. This contrasts strongly with the principles of the LO-SOLIDS technology. Thus, cooking liquor with a high level of dissolved organic material is not withdrawn, and replaced with cooking liquor with a lower level of dissolved organic material, as it is in the LO-SOLIDS technology.

The problem is rather the reverse: it is desired to increase the fraction of dissolved organic material while at the same time maintaining the levels of other added liquors, white liquor, etc., with respect to amount and concentration. It is particularly desired to enrich the cooking liquor with the organic material that advantageously influences delignification and that also contributes, to a certain extent, to an increased yield.

The relevant type of desired supplement for the cooking liquor is already available at the pulp mills, but it is present in the evaporation stage before the recovery. Nobody has yet realised that a partially evaporated black liquor has an advantageous effect on the cooking stage, nor have they realised that the partially evaporated black liquor should be returned to the cooking stage from the evaporation stage.

The main aim of the invention is to increase the selectivity in the cooking stage by accelerating delignification. This results either in the achievement of improved pulp quality (viscosity/pulp strength) and higher yield at the same degree of delignification (reduction in kappa value), or in the achievement of a higher degree of delignification at the same pulp strength and yield.

The invention also allows a positive increase in $OH^-$ and in $HS^-$ ions during the cooking stage, something that in a known manner gives better selectivity and bleachability for the cellulose pulp produced.

Another purpose is the exchange of the improved delignification effect during the cooking stage for at least one of the following advantages:

Smaller continuous digesters, that is: cheaper systems for a given production volume (shorter stoppage times);

Increased production capacity for both batchwise and for continuous cooking, with a maintained pulp quality;

Reduced need for cooking chemicals (alkalis), something that gives lower production costs.

The invention can be used on both steam-phase digesters and on hydraulic digesters; with inverted top separators, with downward-feeding top separators and with types that lack a top separator; and it can be used during the production of cellulose pulp using both the sulphite process and the sulphate process. In the same way, deciduous wood, coniferous wood, annuals (such as bagasse, etc.) and others can constitute the source of cellulose. The invention can be used with batchwise cooking, in which the chips are fed into a vessel in which a sequential treatment with various impregnation liquors and cooking liquors subsequently takes place on the chips that are held stationary in the vessel.

The invention can also be used in continuous digesters, in which pre-evaporated black liquor is added to cooking liquors that pass either upstream or downstream with the chips during the cooking stage, at the beginning of the cooking stage, in the middle, or at its end.

DETAILED DESCRIPTION OF PREFERRED EMBODIMENTS

Figure 1:
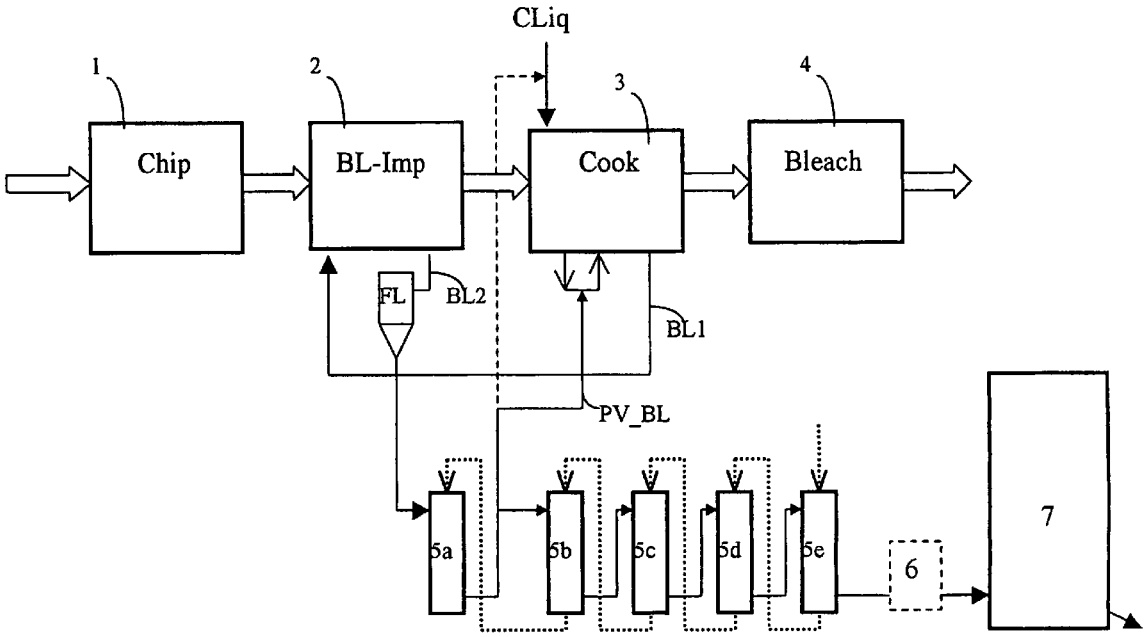
FIG. 1 shows the principles of application of the invention in a cooking system.

FIG. 1 shows schematically a cooking system with the associated recovery of cooking chemicals. The chips are first handled in a chip management system 1 (Chip) in which the chips can preferably be made basic with steam for the expulsion of air and for the first warming of the chips. A first addition of the process liquid occurs here such that the chips become mixed into a chip/liquid mixture.

Black liquor BL1, which has been withdrawn from a subsequent cooking stage, is added at a subsequent impregnation stage (BL-Imp). The black liquor can be added with the chips at the start of the impregnation stage and it can accompany the chips in what is known as downstream treatment, after which the black liquor is withdrawn from the impregnation vessel. This black liquor BL2 normally has a relatively low level of alkali of about 5-20 g/l, and it can, after a pressure reduction in a cyclone/pressure reduction vessel FL, be sent for recovery. The pressure is normally reduced down to a pressure level that does not exceed an excess pressure of 0.5 bar, and often to a pressure that is essentially atmospheric pressure. The cooking process takes place at an elevated pressure, normally with an excess pressure of 5-25 bar in the digester, and a preceding impregnation with black liquor can either take place under pressure or at atmospheric pressure.

The treated chips after impregnation with black liquor are transferred to the digester (Cook) where cooking liquor Cliq is added. The chips are cooked during the cooking stage at a cooking temperature that lies in the interval 150±20° C., after which the cellulose pulp is transferred for further delignification and bleaching (Bleach), preferably passing through an intermediate washing stage (not shown in FIG. 1).

Recovery consists, in a conventional manner, of a number of evaporation stages 5*a*-5*e* in which the black liquor, which is at essentially zero excess pressure, (BL2 after passing through FL) is subject to an evaporation in several stages from an initial level of dry matter content TS in the black liquor (BL2) of 17-20%, to a level that lies over 70-80%. The evaporation line 5*a*-5*e* consists of a number of evaporation stages, know as effects, that the black liquor passes through in sequence, while heating steam is passed in the opposite direction to the flow of black liquor. Normally, the earliest and hottest steam is used in the evaporation stage that treats the black liquor with the greatest level of dry material, that is, the final stage seen from the point of view of the flow of black liquor. Expelled volatile substances are also obtained at each evaporation stage, and these are dealt with by special gas management systems (not shown in FIG. 1) or by turpentine recovery systems, or they are led to other stages in order there to be mixed with the is heating agent (the steam).

Superconcentrators 6 may be included as a last stage of the evaporation, before the black liquor is combusted in a soda recovery furnace 7. A melt is formed in this furnace that is removed from the bottom (as shown in FIG. 1), and that is suspended to form green liquor (not shown) and sent to a causticization plant where white liquor is reformed.

Naturally, in contrast to what is shown in FIG. 1, the first evaporation stage can be constituted by a specially designed evaporation stage that only evaporates that amount of black liquor that is to be recycled to the impregnation stage or the cooking stage. Such a stage can thus be located next to the digester and does not necessarily need to be arranged in association with the other evaporation stages prior to the soda recovery furnace.

According to the invention, a portion of the partially evaporated black liquor PV_BL is thus removed from, for example, the first stage 5*a* and led back to the cooking stage. As is shown schematically in the figure, the pre-evaporated black liquor PV_BL can be added to a digester circulation in which cooking liquor is withdrawn from the cooking stage, normally through strainers in the wall of a continuous digester, and is then returned to the centre of the digester through a central pipe placed at the same height as the strainers. In this way, the pre-evaporated black liquor will become mixed with other treatment liquor before it is added to the cellulose material before the latter is cooked at the actual delignification stage. The pre-evaporated black liquor can, in such an addition process, be added at a location in the digester at which the bulk delignification stage starts.

The pre-evaporated black liquor can, in one alternative, be added to the cooking liquors CLiq that are to be added to the digester before the cooking stage. This alternative is shown using dashed lines in FIG. 1. In this way, the pre-evaporated black liquor can be mixed with other cooking liquors before addition to the digester, and at such an early stage that the pre-evaporated black liquor constitutes part of the cooking liquor at the initial delignification stage of the cooking stage.

The invention can be modified in a number of ways within the framework of the claims.

For example, the invention can also be used during batchwise cooking of chips that have been filled into the vessel, following the sequence:

1) Filling the vessel with chips
2) Heating the chips with steam
3) Heating/impregnation with warm black liquor
4) Heating/impregnation with hot black liquor
5) Cooking with cooking liquor 6) Cleaning compression following the cooking stage, in which the expelled cooking liquor is stored in tanks for hot black liquor
7) Cleaning compression following the previous stages with cleaning liquor, where the liquid expelled first is stored in tanks for warm black liquor.

Emptying of the cooked and washed chips.

In this type of cooking sequence, the pre-evaporated black liquor can be added in batches to the cooking liquor that is added to the chips in step 5 above. Alternatively, a modified impregnation stage according to step 4 above can be used, in which the pre-evaporated black liquor is added in batches to the hot black liquor added in step 4, alternatively the purging of the vessel with pre-evaporated black liquor as a conclusion of step 4, in order to expel residual amounts of hot black liquor that have not been enriched with pre-evaporated black liquor.

As a further alternative, the pre-evaporated black liquor can be added in batches to the cooking stage during the commencement of step 5, whereby the pre-evaporated black liquor is included into a digester circulation for mixture with the cooking liquor that remains in circulation in the vessel during the cooking stage.

The pre-evaporated black liquor consists, according to the invention, of a heat-treated black liquor that has a content of dry matter (TS) that exceeds the level of dry matter that can be obtained in the black liquor that is withdrawn from the process and whose pressure is subsequently reduced. This is equivalent to the black liquor that is denoted by BL2 in FIG. 1 and whose pressure is reduced in at least one pressure reduction vessel, FL in FIG. 1. The content of dry matter TS in this liquor can normally lie around 17-20%, and the content of dry matter TS of the pre-evaporated black liquor is, according to the invention, to be raised by at least 10% from this level, to 27-30%.

An improved effect of the delignification process is obtained even at this modest increase in the content of dry matter. The black liquor is preferably evaporated further to a content of dry matter of at least 30-40%, and preferably at least 50%.

The higher the content of dry matter, the less the optimal liquor/wood ratio will be affected during the cooking stage without having to reduce the necessary batchwise addition of other cooking liquors.

The black liquor that, according to the invention, is pre-evaporated can be constituted by pressurised black liquor that has been directly withdrawn from the digester or indirectly withdrawn through a black liquor impregnation, which may be either under pressure or essentially at atmospheric pressure, and subsequently pre-evaporated. The black liquor may also be constituted by such black liquor that has passed through a reboiler, in which the black liquor is first used to generate steam before being pre-evaporated in the manner according to the invention.

Twice as much recirculated pre-evaporated black liquor with a content of dry matter of 27-30% is normally required than would be required if the content of dry matter was around 60%, given similar conditions in the digester with respect to other parameters.

The amounts that are available for return to the cooking stage depend on:

the current content of dry matter in the pre-evaporated black liquor the current liquid/wood ratio during the cooking stage the amount of black liquor that accompanies the chips from a preceding black liquor impregnation the current raw material (deciduous wood, coniferous wood, annuals, eucalyptus, etc)

the required batchwise addition of white liquor and its concentration of alkali the other types of cooking chemicals that are added.

When liquid/wood ratios that lie at the lower end of the range, around 3-3.5:1, i.e. 3 to 3.5 $m^3$ liquid for each cubic metre of chips, the amount of pre-evaporated black liquor with a content of dry matter around 40% should exceed at least 5% of the total liquid amount, which corresponds to an amount of pre-evaporated black liquor of around 0.15-0.175 $m^3$ for each cubic metre of chips, in order for an appreciable effect of the delignification to be achieved. At higher liquid/wood ratios during the cooking stage, from around 7:1 and up towards 8:1, an equivalent increase of the minimum amount of pre-evaporated black liquor that may, at the most, be required is around 0.35-0.40 $m^3$ per cubic metre of chips, in order to achieve an appreciable effect on the delignification. If the increased liquid/wood ratio in the cooking zone is established by internal recirculation of the cooking liquor, the required increase for an effect on the delignification will be smaller.

Thus, relatively modest amounts of pre-evaporated recirculated black liquor are sufficient that in normal cases amount to a few percent of the total amount of liquor in the cooking stage.

As much as 20-40% of the total amount of liquor can be constituted by pre-evaporated black liquor in cooking situations in which the cooking process has been established with a very low fraction of residual black liquor from the impregnation.

The invention, however, is not uniquely determined by the amounts that are recycled since, as has been previously mentioned, other process parameters during the cooking stage can influence the amount required, as can the type of cellulose pulp (deciduous wood, coniferous wood, annuals, etc.) that is being cooked.

The invention is based on the principle of retuming, in contrast to other cooking methods, dissolved organic material to the cooking process, which released organic material has been enriched by initially undergoing substantial evaporation with the purpose of increasing the content of dry matter in the black liquor. Thus, the concentration of the organic material increases, which has surprisingly turned out to influence the delignification process in an advantageous manner and to contribute to increased yield, principally due to the hemicellulose in the pre-evaporated black liquor being reprecipitated onto the cellulose fibres.

It is important for obtaining the best effect that the pre-evaporated black liquor is present during the main part of the bulk delignification stage, more than 50% of the retention time of the chips in the bulk delignification stage, and preferably during the initial delignification stage.

The recycled pre-evaporated liquor can be further heat-treated in a separate stage and/or certain fractions can be mechanically separated, and it can be adjusted with respect to the levels of other chemicals.

The invention claimed is:

1. A method for the production of cellulose pulp, comprising:

adding an impregnation liquor to an impregnation stage;

treating wood chips in the impregnation stage with the impregnation liquor at an impregnation temperature;

cooking the wood chips in a cooking stage by using a cooking liquor having a cooking temperature of 150±20° C., the cooking temperature being higher than the impregnation temperature;

withdrawing black liquor from the impregnation stage, the withdrawn black liquor being at the impregnation temperature and having a first concentration of dry matter (TS);

subjecting the withdrawn black liquor to a pressure reduction in a pressure-reduction vessel to form a pressure-reduced black liquor having a second concentration of dry matter (TS), the second concentration being higher than the first concentration;

conveying the pressure-reduced black liquor to an evaporation stage;

in the evaporation stage, forming a partially evaporated black liquor, the partially evaporated black liquor having a third concentration of dry matter (TS), the third concentration having a dry matter (TS) concentration that is at least 10% higher than a dry matter (TS) concentration of the second concentration of the pressure-reduced black liquor;

adding the partially evaporated black liquor to the cooking liquor at a start of or during a delignification stage; and cooking the wood chips in the cooking stage to produce cellulose pulp.

2. The method according to claim 1, wherein the partially evaporated black liquor has a concentration of dry matter (TS) in the partially evaporated black liquor that exceeds 30%.

3. The method according to claim 2, wherein the partially evaporated black liquor has a concentration of dry matter (TS) in the partially evaporated black liquor that exceeds 50%.

4. The method according to claim 1, wherein the partially evaporated black liquor is mixed with another treatment liquor before the partially evaporated black liquor is added to the wood chips prior to the wood chips being cooked in a delignification stage.

5. The method according to claim 1 wherein the method further comprises reducing a pressure of the withdrawn black liquor in at least one pressure-reduction tank down to a pressure that does not exceed an excess pressure of 0.5 bar and evaporating the pressure-reduced black liquor in at least one primary evaporation step in which the evaporated black liquor is heated during a removal of volatile substances from the evaporated black liquor to increase a content of dry material.

6. The method according to claim 5, wherein the method further comprises making the primary evaporation step part of a recovery plant for black liquor.

7. The method according to claim 5, wherein the primary evaporation stage is constituted by a dedicated evaporation stage that only evaporates an amount of black liquor that is to be returned to the impregnation or cooking stage.

8. The method according to claim 1 wherein the partially evaporated black liquor is added to the cooking liquor so that the partially evaporated black liquor is present during at least part of an initial delignification stage of a cooking stage.

9. The method according to claim 1 wherein the partially evaporated black liquor is present during more than 50% of a retention time of the wood chips in a bulk delignification stage.

10. The method according to claim 1 wherein the third concentration has a concentration of dry matter (TS) in the partially evaporated black liquor that is in a range of 27-30%.

11. The method according to claim 1 wherein the partially evaporated black liquor is mixed with cooking liquor before being added to the start of or during the delignification stage of the digester.

12. The method according to claim 1 wherein the method further comprises treating wood chips in several stages including impregnation and cooking stages at successively increasing temperatures.

* * * * *